US011317221B2

(12) United States Patent
Karamuk et al.

(10) Patent No.: US 11,317,221 B2
(45) Date of Patent: Apr. 26, 2022

(54) METHOD AND APPARATUS FOR IN-EAR ACOUSTIC READOUT OF DATA FROM A HEARING INSTRUMENT

(71) Applicant: Sonova AG, Staefa (CH)

(72) Inventors: Erdal Karamuk, Maennedorf (CH); Paul Wagner, Meilen (CH); Daniel Baer, Zurich (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/055,094

(22) PCT Filed: May 15, 2018

(86) PCT No.: PCT/IB2018/000731

§ 371 (c)(1),
(2) Date: Nov. 12, 2020

(87) PCT Pub. No.: WO2019/220167

PCT Pub. Date: Nov. 21, 2019

(65) Prior Publication Data

US 2021/0227336 A1 Jul. 22, 2021

(51) Int. Cl.

| | |
|---|---|
| ***H04R 25/00*** | (2006.01) |
| ***H04R 1/08*** | (2006.01) |
| ***H04R 1/28*** | (2006.01) |

(52) U.S. Cl.

CPC ..... *H04R 25/30* (2013.01); *H04R 1/08* (2013.01); *H04R 1/2838* (2013.01);
(Continued)

(58) Field of Classification Search

CPC ..... H04R 25/30; H04R 1/08; H04R 1/2838; H04R 25/505; H04R 25/554; H04R 25/558; H04R 25/70; H04R 2225/023
(Continued)

(56) References Cited

U.S. PATENT DOCUMENTS

| | | | | |
|---|---|---|---|---|
| 9,456,285 | B2 | 9/2016 | Bymaster et al. | |
| 2005/0031136 | A1* | 2/2005 | Du | H04R 3/005 381/91 |

(Continued)

FOREIGN PATENT DOCUMENTS

| | | | |
|---|---|---|---|
| DE | 102004035800 | A1 | 3/2006 |
| EP | 0 480 097 | A1 | 4/1992 |

(Continued)

OTHER PUBLICATIONS

International Searching Authority, International Search Report for PCT/IB2018/000731, European Patent Office, P.B. 5818 Patentlann 2, NL-2280 HV Rijswijk, pp. 1-13.

*Primary Examiner* — Sean H Nguyen
(74) *Attorney, Agent, or Firm* — ALG Intellectual Property, LLC

(57) ABSTRACT

Systems and methods for two-way communication with a hearing device are disclosed. In one embodiment, an accessory for communication with a hearing device includes an acoustic filter, and a microphone configured as an acoustic receiver (RX) for acoustic signals from a speaker of the hearing device via the acoustic filter. The acoustic filter is configured to operate at at least one resonance frequency. The accessory is in acoustic and magnetic communication with the hearing device.

14 Claims, 12 Drawing Sheets

(52) U.S. Cl.
CPC ..... *H04R 25/505* (2013.01); *H04R 25/554* (2013.01); *H04R 25/558* (2013.01); *H04R 25/70* (2013.01); *H04R 2225/023* (2013.01)

(58) Field of Classification Search
USPC ..... 381/60
See application file for complete search history.

(56) References Cited

U.S. PATENT DOCUMENTS

| | | | | |
|---|---|---|---|---|
| 2006/0210104 | A1 | 9/2006 | Shennib et al. | |
| 2007/0104343 | A1 | 5/2007 | Bengtsson | |
| 2012/0177212 | A1* | 7/2012 | Hou | H04R 25/70 381/60 |
| 2014/0023213 | A1* | 1/2014 | Zhang | H04R 25/405 381/313 |
| 2018/0109886 | A1* | 4/2018 | Nielsen | H04R 25/505 |
| 2020/0021921 | A1* | 1/2020 | Park | H04R 25/55 |
| 2020/0322738 | A1* | 10/2020 | Elmedyb | H04R 25/505 |

FOREIGN PATENT DOCUMENTS

| | | |
|---|---|---|
| EP | 1 315 399 A2 | 5/2003 |
| EP | 1 538 873 A2 | 6/2005 |
| EP | 2 613 566 A1 | 7/2016 |
| GB | 1 581 187 A | 12/1980 |

* cited by examiner

FIG. X

METHOD AND APPARATUS FOR IN-EAR ACOUSTIC READOUT OF DATA FROM A HEARING INSTRUMENT

FIELD OF THE INVENTION

The innovative technology relates generally to hearing instruments, and more particularly relates to methods and apparatuses for reading data from the hearing instruments.

BACKGROUND

Hearing instruments (also referred to as "hearing aids" or "hearing devices") are designed to be worn continuously behind the ear or inside the ear for extended periods of time. Hearing instruments may be designed for a daily wear and a continuous wear. Daily wear hearing instruments are designed to be worn for up to 12 hours between removals. Behind the ear (BTE) hearing instruments are usually designed for daily wear. On the other hand, continuous wear hearing instruments are designed to be worn for weeks or months at a time between removals. The continuous wear instruments are more common for deep completely in the channel (CIC) use.

Hearing instruments must be accessed from time to time to, for example, adjust their settings, read the serial number of the device, reprogram the device, etc. Accessing a hearing instrument outside the ear (e.g., a BTE hearing instrument) is relatively simple. However, once the hearing instrument is placed in the ear canal, the removal of the instrument is an involved process that is typically performed by a specially trained person.

With some conventional technologies, the hearing instrument can receive data while inside the ear canal. With these conventional technologies, an outside accessory operates as a transmitter (TX), while the hearing instrument operates as a receiver (RX). In response to the signals received from the TX, these conventional hearing instruments can, for example, adjust the settings (e.g., by setting the switches in the hearing) instrument while the hearing instrument stays in the ear canal.

In some situations, two-way communication between the hearing instrument and the outside accessory is required to read the status of the hearing instrument, verify the serial number, review calibration results, etc. However, sending radio signals or magnetic signals from hearing instruments to a remote accessory requires significant power budget. Hearing instruments placed in the ear can only carry a small battery, capable of providing a relatively low current over the course of use of the instrument, which is typically several months. Furthermore, hearing instruments that are placed completely in the ear canal (also referred to as "CIC" hearing instruments or hearing aids) are even smaller, and the battery even more limited. Therefore, a two way communication between the hearing instrument and the remote receiver can quickly drain the battery of the hearing instrument.

In addition to the above issues relate to hearing instruments, conventional extended-wear CIC hearing instruments have additional deficiencies. For example, in absence of signals sent by the hearing instrument, it is difficult or impossible to determine whether the hearing instrument is functioning correctly, and whether the instrument successfully received programming data sent by the accessory. Accordingly, there remains a need for power-efficient methods and systems for two-way communication between a hearing instrument and an outside accessory.

SUMMARY

This summary is provided to introduce a selection of concepts in a simplified form that are further described below in the Detailed Description. This summary is not intended to identify key features of the claimed subject matter.

The inventive technology provides for contact-free, bidirectional communication between a hearing instrument and an outside accessory. The hearing instrument may receive signals from the accessory (e.g., magnetic signals), and then respond by sending acoustic signals from the hearing instrument's built-in speaker back to the proximally located accessory. For example, the hearing instrument may emit acoustic signals at high frequency to represent a binary "1" and at low frequency to represent a binary "0". The stream of the binary bits may represent, for example, a serial number of the hearing instrument; temperature, humidity, or other readings from onboard sensors; battery voltage; battery limiting current; device impedance; speaker current; values of the settable switches; volatile memory settings, total power usage; and/or other parameters of the hearing instrument.

The acoustic signals reaching the accessory are generally weak because (i) the electrical current available to the speaker of the hearing instrument is relatively low, (ii) the power of the acoustic signal should be limited as to not annoy the user by strong acoustic signal, and (iii) the acoustic signal further attenuates on its path to the accessory. In some instances, the acoustic signal may attenuate by up to 40 dB as it propagates across the seals of the hearing instrument from the medial end to lateral end of the device. To amplify the received acoustic signal, the accessory may include channels that are frequency-tuned to amplify select frequencies (e.g., the frequencies of the acoustic frequencies corresponding to bits 0 and 1).

One or more microphones can be placed at the end of the tuning channels to acquire the acoustic signals arriving from the hearing instrument. Therefore, in some embodiments, the multiple microphones are treated as a phased array, and their signals are summed (with proper phase offsets) to improve the signal to noise ratio (SNR).

The operating frequency of the clock signal generator in the hearing instrument may vary with time, temperature, and/or battery voltage. As a result, the frequency of the acoustic signals also varies or drifts, even during a single acoustic readout event. Furthermore, background acoustic noise (e.g., fitter-patient conversations, air conditioning fans, printers, contact between the programming accessory and skin/hair in the ear canal, etc.) may be significant in comparison to relatively weak acoustic signals generated by the speaker of the hearing instrument. In some embodiments of the inventive technology, the acoustic signals acquired by the microphones are processed to detect the frequency peaks corresponding to the binary 0 and 1, and to exclude the portions of signals that are contaminated by excessive noise using, for example, thresholding algorithms. Because the battery carried by the accessory can be much larger than that of the hearing instrument, the electronics of the accessory generally have sufficient power to process the signals from the hearing instruments.

In one embodiment, an accessory for communication with a hearing device includes: an acoustic filter; and a microphone configured as an acoustic receiver (RX) for acoustic signals from a speaker of the hearing device via the acoustic filter. The acoustic filter is configured to operate at at least one resonance frequency. In one aspect, the accessory of claim 1 includes a first acoustic channel having a first cross sectional area.

In another aspect, the acoustic filter includes a second acoustic channel having a second cross sectional area. The second cross sectional area is smaller than the first cross sectional area. The first acoustic channel and the second channel are connected, and the microphone is placed at a longitudinal end of the second channel.

In one aspect, the microphone is a first microphone configured at a longitudinal end of the first acoustic channel, the acoustic filter includes a second acoustic channel having a second cross sectional area, the second cross sectional area is smaller than the first cross sectional area, and the second microphone is placed at a longitudinal end of the second channel.

In one aspect, the accessory is configured for acoustic and magnetic communication with the hearing device. In another aspect, the accessory is an element of a hearing system, and the hearing system includes the hearing device.

In one aspect, the acoustic filter is a first acoustic filter, and the accessory further includes: a second acoustic filter, having a third channel having a third diameter; a fourth channel having a fourth diameter, where the third and fourth channels are connected, and where the fourth diameter is smaller than the third diameter. The accessory also includes a second microphone configured as an acoustic RX for acoustic signals from the speaker of the hearing device via the second acoustic filter.

In one aspect, the microphone is a first microphone, the accessory further includes a second microphone configured to detect a background noise. In another aspect, the first acoustic channel has a first length and the second acoustic channel has a second length, and at least one of the first cross sectional area, the second cross sectional area, the first length and the second length are adjustable.

In one aspect, the first acoustic channel and the second acoustic channel are at least partially configured within an elongated protruding tip of the accessory.

In one aspect, the accessory also includes an analog to digital converter (A/D) operatively coupled with the microphone; and a controller configured to process digital data obtained by the A/D. In another aspect, the hearing device is a completely in ear canal (CIC) hearing device.

In one embodiments, a method for a two-way communication with a hearing device includes: sending a first accessory signal from an accessory to the hearing device; in response to the first accessory signal, emitting a first acoustic signal by a speaker of the hearing device; and receiving the first acoustic signal by a microphone of the accessory. In one aspect, the first and second acoustic signals are emitted at one of two acoustic frequencies. In another aspect, a ratio of the two acoustic frequencies or their harmonics is approximately 2:1, approximately 3:1, approximately 3:2, approximately 3:1, approximately 4:3, approximately 5:2, or approximately 5:3.

In one aspect, the microphone is a first microphone, the accessory further includes a second microphone, and the method further includes: processing digitized signals from the first microphone and the second microphone by: determining a phase offset between the first microphone and the second microphone; subtracting a common noise from the first microphone and the second microphone; and summing digitized signals from the first microphone and the second microphone, where the digitized signals are adjusted for the phase offsets.

In another aspect, the method further includes: in response to receiving the first acoustic signal, sending a second accessory signal to the hearing device to request a second acoustic signal; in response to the second accessory signal, emitting a second acoustic signal by the speaker of the hearing device; receiving the second acoustic signal by the microphone of the accessory; and in response to receiving the second acoustic signal, sending a third accessory signal to the hearing device to request a third acoustic signal.

In one aspect, emitting the first acoustic signal by the microphone of the hearing device terminates when the second accessory signal is received by the hearing device. In another aspect, the second accessory signal is emitted after the first acoustic signal remains below a threshold intensity in a time domain or a frequency domain for a duration of a predetermined dwell time. In one aspect, the first and second accessory signals are magnetic signals emitted by the accessory.

In one embodiment, a non-transitory computer readable medium having computer executable instructions stored thereon is configured to, in response to execution by one or more processors of a computing device, cause the computing device to perform actions including: sending a first accessory signal from an accessory to the hearing device; in response to the first accessory signal, emitting a first acoustic signal by a speaker of the hearing device; receiving the first acoustic signal by a microphone of the accessory; and in response to receiving the first acoustic signal, sending a second accessory signal to the hearing device to request a second acoustic signal. In one aspect, the accessory includes an acoustic filter, having: a first acoustic channel having a first diameter; and a second acoustic channel having a second diameter. The first channel and the second channel are connected, where the second diameter is smaller than the first diameter, and where the microphone is placed at a longitudinal end of the second channel. The microphone is acoustically connected with the speaker of the hearing device via the acoustic filter.

DESCRIPTION OF THE DRAWINGS

The foregoing aspects and the attendant advantages of the inventive technology will become more readily appreciated as the same become better understood by reference to the following detailed description, when taken in conjunction with the accompanying drawings, wherein.

DETAILED DESCRIPTION

The following disclosure describes various embodiments of systems and associated methods for in-ear acoustic readout of data from a hearing instrument. A person skilled in the art will also understand that the technology may have additional embodiments, and that the technology may be practiced without several of the details of the embodiments described below with reference to FIGS. 1-8B.

Figure 1:
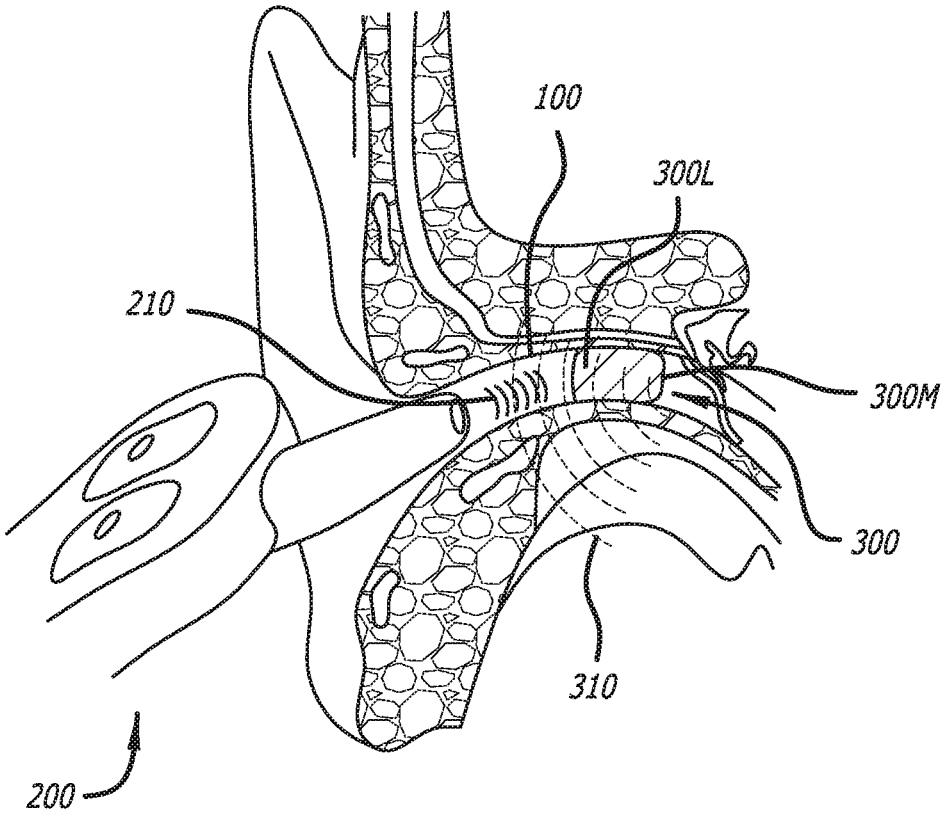
FIG. 1 is a schematic view of a hearing instrument inside an ear canal in accordance with an embodiment of the presently disclosed technology.

FIG. 1 is a schematic view of a hearing instrument 300 inside an ear canal in accordance with an embodiment of the presently disclosed technology. In operation, an accessory 200 (also referred to as a "programming accessory") sends signals 210 (e.g., pulses of magnetic field) to the hearing instrument 300. Signals 210 can be interpreted by the hearing instrument 300 through, for example, a built-in giant magnetoresistive sensor (GMR). In some embodiments, signals 210 represent a request for information to be sent from the hearing instrument 300 back to the accessory 200. The requested information may be, for example, the serial number of the device, calibration results, battery voltage, etc.

In response to signals 210, the hearing instrument 300 generates acoustic signals 310 through a speaker 301. The acoustic signals 310 may binary-encode serial number of the device, battery voltage, or other parameters requested by the accessory 200. After receiving one bit of information from the hearing instrument 300, the accessory 200 may request the next bit by sending additional signals 210 to the hearing instrument 300. In response, the speaker 301 generates another acoustic signal that encodes the next bit of information for the accessory 200. Next, the accessory 200 receives that bit of information, requests the further bit of information, and so on. In some embodiments, the information from the hearing instrument (e.g., the serial number) can be obtained while the hearing instrument is still sealed inside its packaging. Some embodiments of the acoustic signal encoding are described below with reference to FIG. 2.

Figure 2:
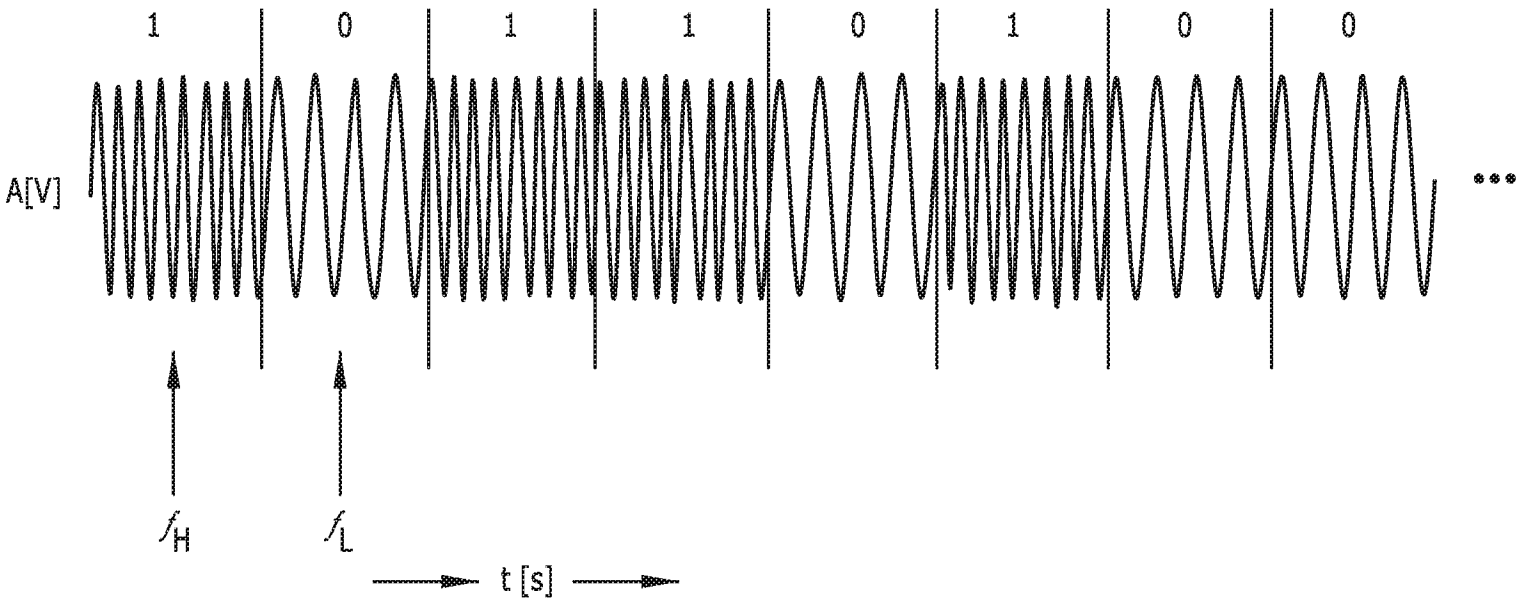
FIG. 2 is a graph of a bit stream emitted by a hearing instrument in accordance with an embodiment of the presently disclosed technology.

FIG. 2 is a graph of a bit stream emitted by the hearing instrument 300 in accordance with an embodiment of the presently disclosed technology. In the illustrated embodiment, the hearing instrument generates acoustic signals at two frequencies: high frequency $f_H$ corresponding to binary "1" and low frequency $f_L$ corresponding to binary "0". The illustrated sample sequence of bits is "1 0 1 1 0 1 0 0". Each bit is acoustically emitted by the hearing instrument for a duration of time, and the bit is received and saved by the accessory.

In operation, the actual high frequency $f_H$ and low frequency $f_L$ may drift with changes in battery voltage, temperature, etc. In some embodiments, this frequency drift may be about 50 Hz or more. Moreover, there may be a static offset in frequency from device to device of 500 Hz or more, arising from variations in the ASIC manufacturing process, tolerances in discrete components, battery voltage, etc. Herein, the terms "about" and/or "approximately" refer to the ranges within 5% or with 1% from the nominal value. However, the ratio of $f_H$ to $f_L$ generally remains relatively stable in spite of the frequency drift. For example, in some embodiments, the clock oscillator of the hearing instrument 300 may oscillate at 1 MHz. The high frequency $f_L$ may be derived from every $200^{th}$ cycle of the base clock, thus resulting in $f_H$ of 5 kHz, and the low frequency $f_L$ may be derived from every $400^{th}$ cycle of the base clock, thus resulting in the $f_L$ of 2.5 kHz. In other embodiments, different frequencies of the acoustic signal are derivable from the base clock of the hearing instruments. In general, even though frequency of the base clock of the hearing instrument may drift over time, the ratio of $f_H$ to $f_L$ can be preserved within a period of time.

In some embodiments, different ratios of the $f_H$ to $f_L$ may be used. For example, a ratio of $f_H$ to $f_L$ that is greater than 2 may improve signal to noise ratio (SNR) of the acoustic signal at the accessory, because the spectral peaks of the acoustic signal are further apart. Some nonexclusive examples of the ratios of $f_H$ to $f_L$ are 3:1, 3:2, 4:3, 5:2, and 5:3. In some embodiments, more than two frequencies may be used to encode the information sent by the speaker of the hearing instrument. For example, a ternary encoding using three frequencies may be used. In other embodiments, other number of frequencies corresponding to different encoding bases may be used.

Figure 3A:
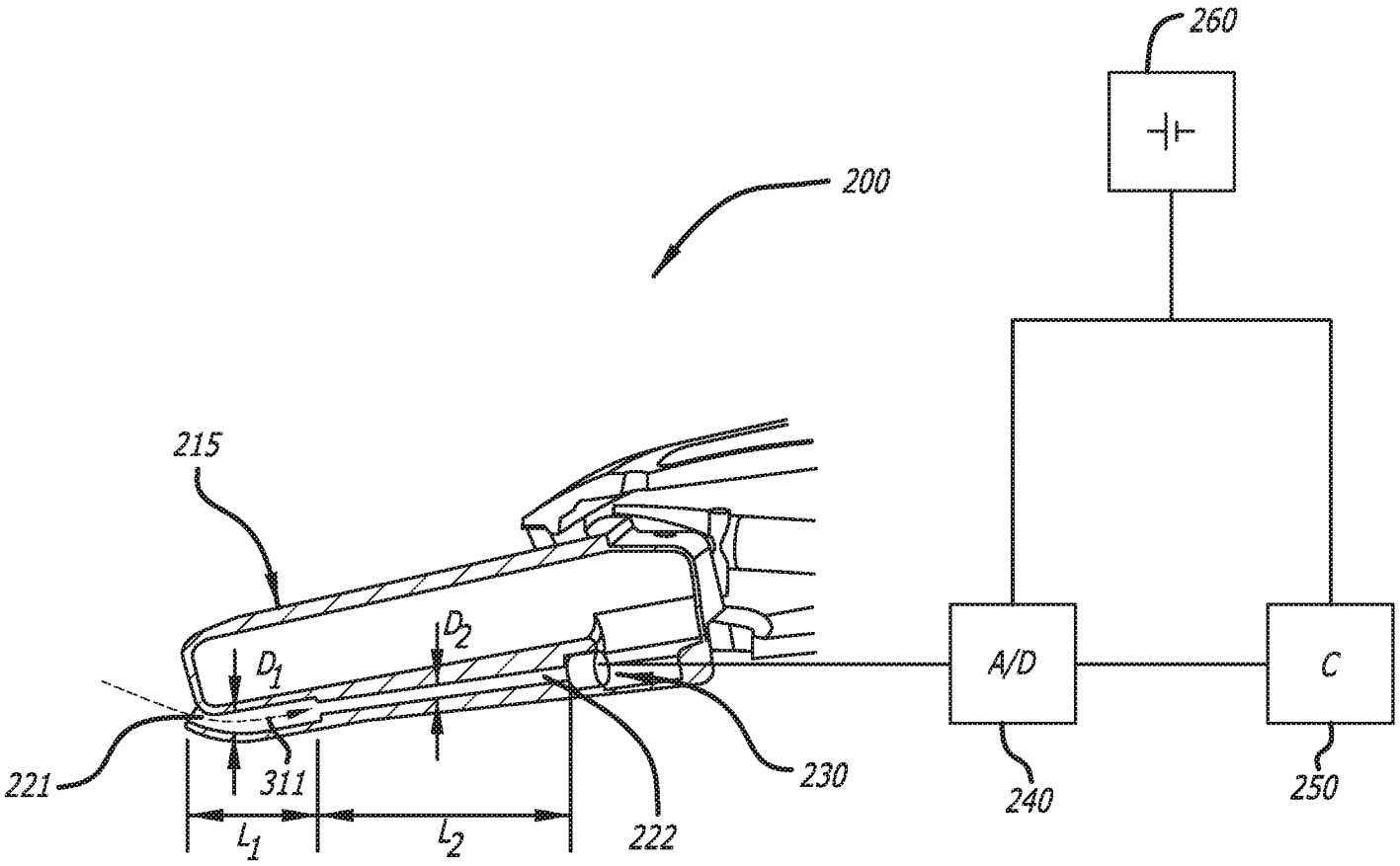
FIGS. 3A and 3B are cross-sections of accessories in accordance with embodiments of the presently disclosed technology.
Figure 3B:
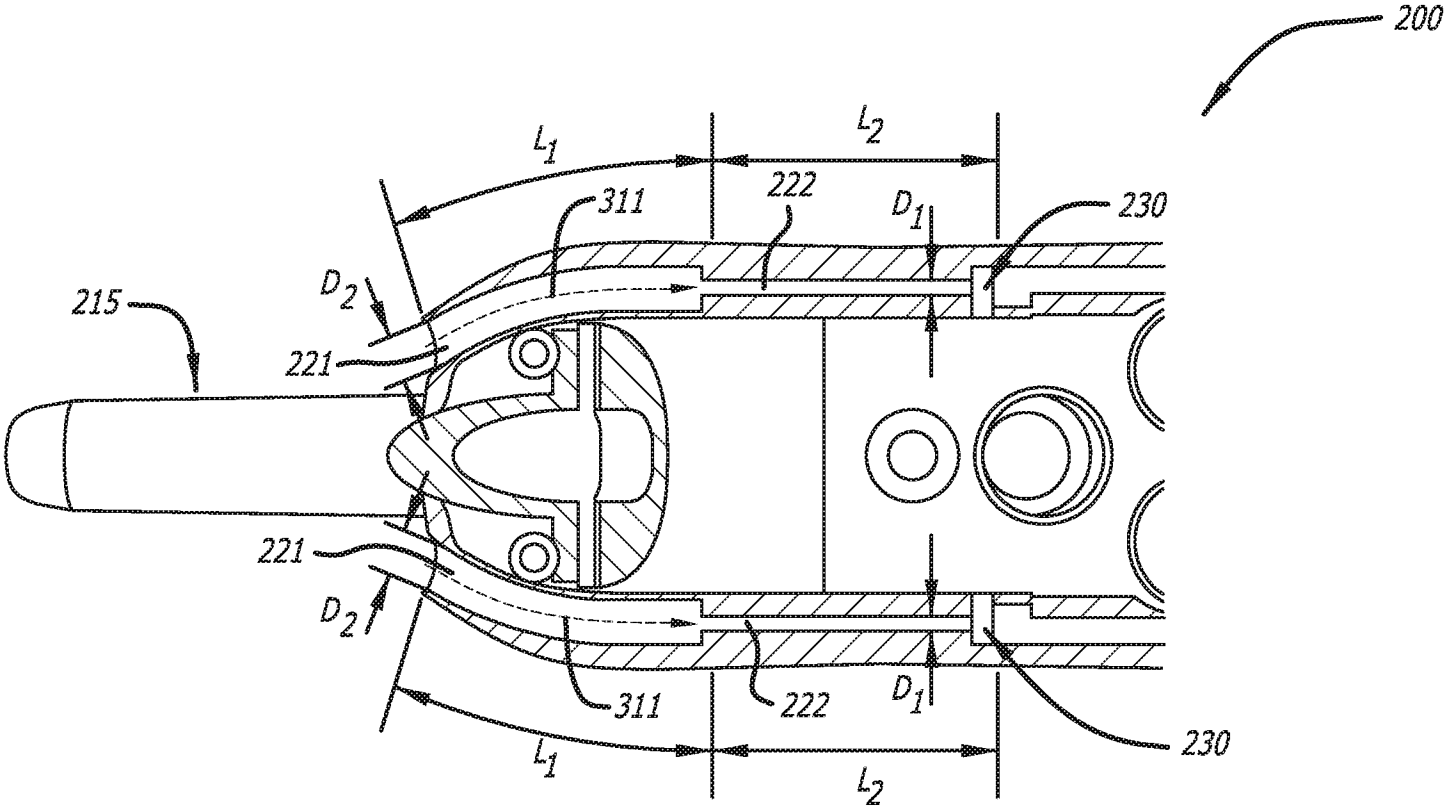

FIGS. 3A and 3B are cross-sections of accessories in accordance with embodiments of the presently disclosed technology. In operation, a wand 215 (also referred to as a "protruding tip") of the accessory 200 faces a hearing instrument in the ear and may be partially inserted into the ear canal. The opening in the wand 215 may include a replaceable wax filter to reduce clogging of the wand 215.

Because the speaker of the hearing instrument is placed to face the ear drum, the emitted acoustic signals reflect against the ear drum, pass the hearing instrument in the ear canal, and propagate toward the accessory 200. As a result, the already weak acoustic signal emitted by the speaker is further attenuated as it reaches the accessory 200. In some embodiments, the acoustic signal may be attenuated by 40 dB. Therefore, the accessory 200 may include features that selectively amplify the received signal and process the acquired signal to improve the SNR.

FIG. 3A shows an embodiment of the accessory 200. The accessory 200 includes a first channel 221 and a second channel 222. In some embodiments, the first channel 221 is dimensioned to amplify a low frequency acoustic signal (e.g., the acoustic signal corresponding to binary 0). For example, a diameter D1 and/or a length L1 of the first channel 221 may correspond to a multiple of the wavelength of the acoustic signal at the low frequency $f_L$. Analogously, the second channel 222 may have a diameter D2 and a length L2 that are dimensioned to amplify the acoustic signal at the high frequency $f_H$. Stated differently, the first channel 221 resonates at or close to the low frequency $f_L$, and the second channel 222 resonates at or close to the high frequency $f_H$. Arrow 311 represents propagation of the acoustic signal in the channels 221, 222. In the illustrated embodiment, the first and second channels 221, 222 (also referred to as "acoustic channels") are connected, but in other embodiments the first and second data channels may be separated. Collectively, the first and second channels 221, 222 may be termed "acoustic filter," because they selectively resonate at certain frequencies (e.g., the low frequency $f_L$, the high frequency $f_H$, etc.), while dampening other frequencies. In different embodiments, different combinations of the channels (e.g., number of channels, configurations of the channels, etc.) are also collectively referred to as the acoustic filters.

The transfer function of channels 221, 222 can be tuned through the selection of the lengths and diameters of the two channels. In some embodiments, the channels 221, 222 may be tunable in real time using, for example, screw drives that shorten the channel, inserts that reduce the diameter of the channel or change the acoustic property of the channel, etc. Here, the word "diameter" is used as a measure of a cross-sectional area of the channel even when the cross-sectional area of the channel is not round. In different embodiments, the cross-sectional area of the channel may be, for example, circular, elliptical, crescent-shaped or polygonal.

A microphone 230 may be placed at the end of the second channel 222. By passing through the channels 221, 222, the acoustic signal that reaches the microphone 230 is selectively filtered to amplify $f_L$ and $f_H$. The signal can be further digitized by an analog to digital converter 240, and stored in a computing device 250 (e.g., computer, memory device, controller, etc.). Because the accessory 200 is away from the ear canal, it can carry a battery 260 that is large enough to power the electronics of its receiver (RX) and the source of the transmitter (TX) magnetic pulses.

FIG. 3B shows another embodiment of the accessory 200. The illustrated accessory 200 includes two microphones 230, each at the end of a pair of channels 221, 222 configured to selectively amplify the incoming acoustic signal at $f_L$ and $f_H$. Due to different distances from the microphones to the speaker of the hearing instrument, the microphones 230 receive acoustic signals at slightly different times, corresponding to different phases of the same acoustic wave. For example, the acoustic signal received by the microphone which is closer to the speaker of the hearing instrument may have a phase $\phi$, while the acoustic signal received by the microphone which is more distant from the speaker may have a phase $\phi+\Delta\phi$. Therefore, in at least some embodiments, the combination of the microphones 230 operates as a phased array receiver (also referred to as a beamformer). The phase difference between the microphones 230 can be determined by processing their digitized acoustic signals. When the signals from the microphones 230 are properly summed to account for the phase differences, the accuracy of the resulting signal (e.g., the SNR of the resulting signal) may improve. Two microphones 230 are shown in the illustrated embodiment, but other numbers of microphones may be used. For example, a dedicated microphone may be used to register background noise. In different embodiment, such a microphone may be carried by the accessory or may be away from the accessory. In some embodiments, the signals from multiple microphones may be used for noise cancellation. Generally, the accuracy of the signal processing improves with an increased number of microphones.

Figure 3C:
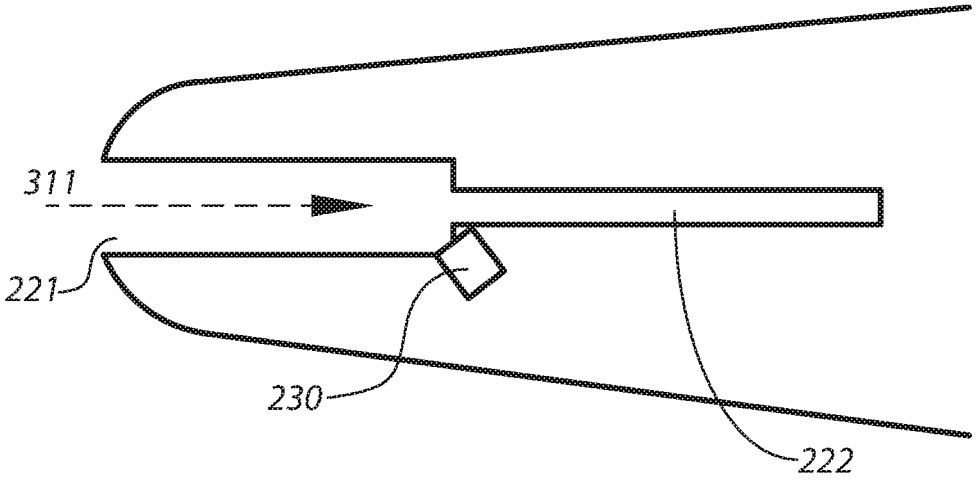
FIGS. 3C and 3D are schematic drawings of accessories in accordance with embodiments of the presently disclosed technology.
Figure 3D:
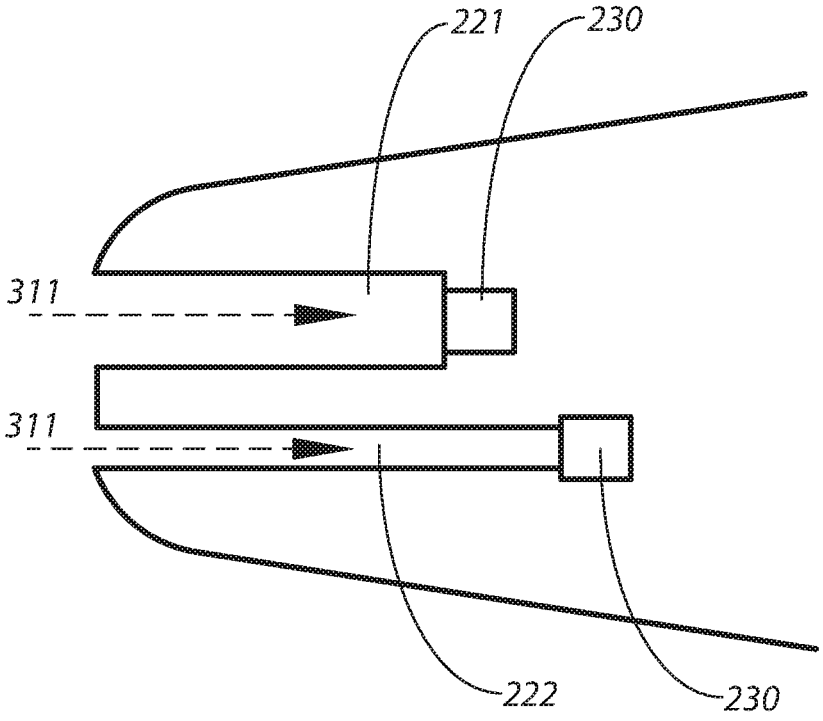

FIGS. 3C and 3D are schematic drawings of accessories in accordance with embodiments of the presently disclosed technology. In particular, FIG. 3C shows a serial configuration of the first channel 221 and the second channel 222. The microphone is placed near the junction of the first channel 221 and the second channel 222. FIG. 3D shows a parallel configuration of the first channel 221 and the second channel 222. In the illustrated embodiments, each of the first and second channels 221, 222 is equipped with dedicated microphone 230.

Figure 4:
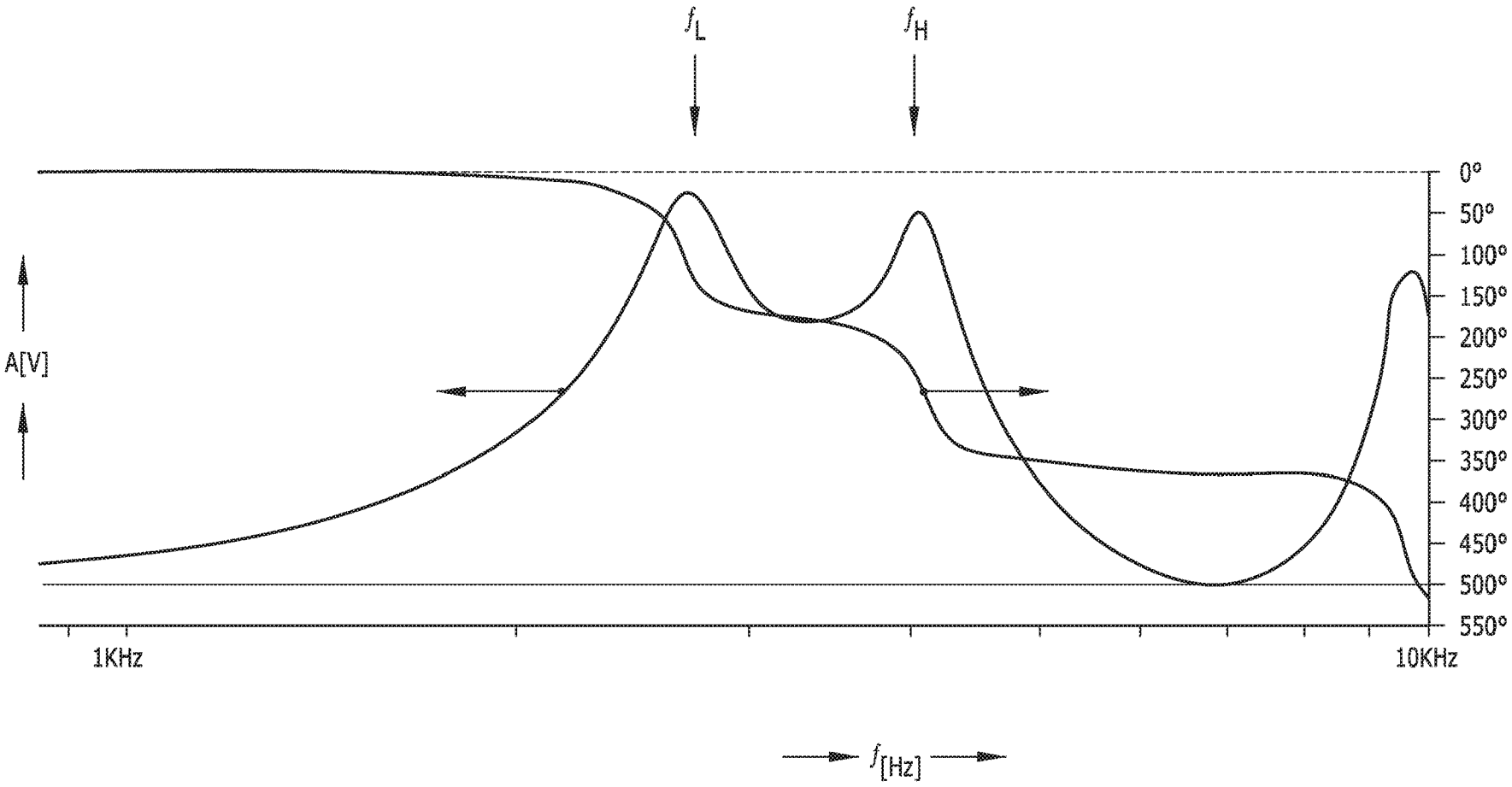
FIG. 4 is a spectral graph of frequencies in a signal emitted by a hearing instrument in accordance with an embodiment of the presently disclosed technology.

FIG. 4 is a spectral graph of frequencies in signals emitted by a hearing instrument in accordance with an embodiment of the presently disclosed technology. The horizontal axis is signal frequency, the left vertical axis is signal amplitude, and the right vertical axis is signal phase. As explained with reference to FIGS. 3A and 3B, the channels leading to the microphone include sections of different lengths and effective cross-sectional areas. The transfer function of this channel structure corresponds to a dual peak resonator having frequency peaks at $f_L$ and $f_H$, corresponding to the two target frequencies for the receiver of the accessory. In some embodiments, the channels of the accessory may amplify acoustic signals by 20 dB.

Figure 5:
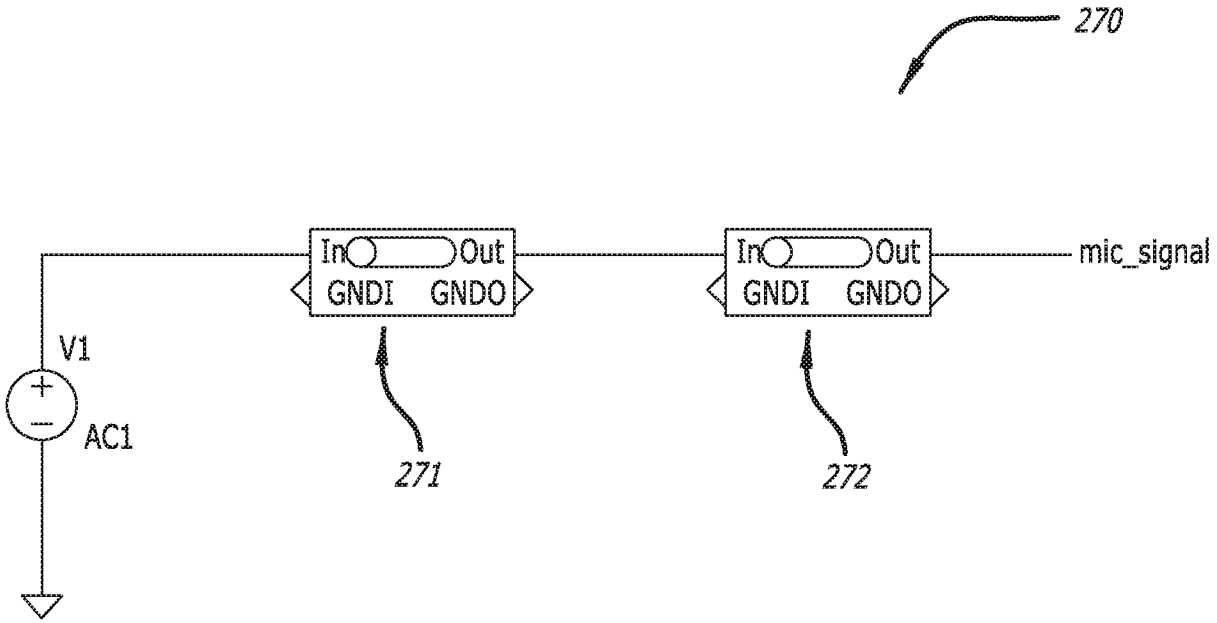
FIG. 5 is a schematic transmission line model for an accessory in accordance with an embodiment of the presently disclosed technology.

FIG. 5 is a schematic transmission line model 270 for an accessory in accordance with an embodiment of the presently disclosed technology. The transmission line model includes a transmission line 271 representing channel 221 and a transmission line 272 representing channel 222. The series connection and mutual interaction of the transmission lines 271 and 272 lead to a dual-resonance system. For example, when the transmission lines 271 and 272 are in a series configuration, and both transmission lines (representing both channels 221 and 222) have equal lengths, changing the ratio of the cross-sectional areas of the two equal-length channels changes the separation of the two peaks in the frequency spectrum: ratios close to 1 will result in the peaks being very close together, while ratios greater than 1 or smaller than 1 will result in the peaks being farther apart. As another example, altering the lengths of both channels 221 and 222 in the same direction will shift both resonance peaks up toward higher frequencies in unison as the channels become shorter, or down toward lower frequencies as the channels become longer. In many embodiments, the frequencies of the peak gains for the channels of the accessory are mutually distant enough to individually amplify the $f_L$ and $f_H$.

In some embodiments, the speaker of the hearing instrument outputs square waves rather than sine waves, thus producing significant levels of third order harmonics in the acoustic signal. Therefore, with some embodiments, it may be advantageous to shape the first and second channels (i.e., the acoustic resonators) of the accessory such that they bandpass high frequency $f_H$ and the third order harmonic of the low frequency $f_L$, rather than the low frequency itself. With such an accessory, the ratio of frequencies filtered by the accessory and acquired by the microphones would be 2:3 instead of 2:1. As another non-limiting example, if a fifth order harmonic of the low frequency $f_L$ is used, the ratio of frequencies becomes 2:5.

Figure 6A:
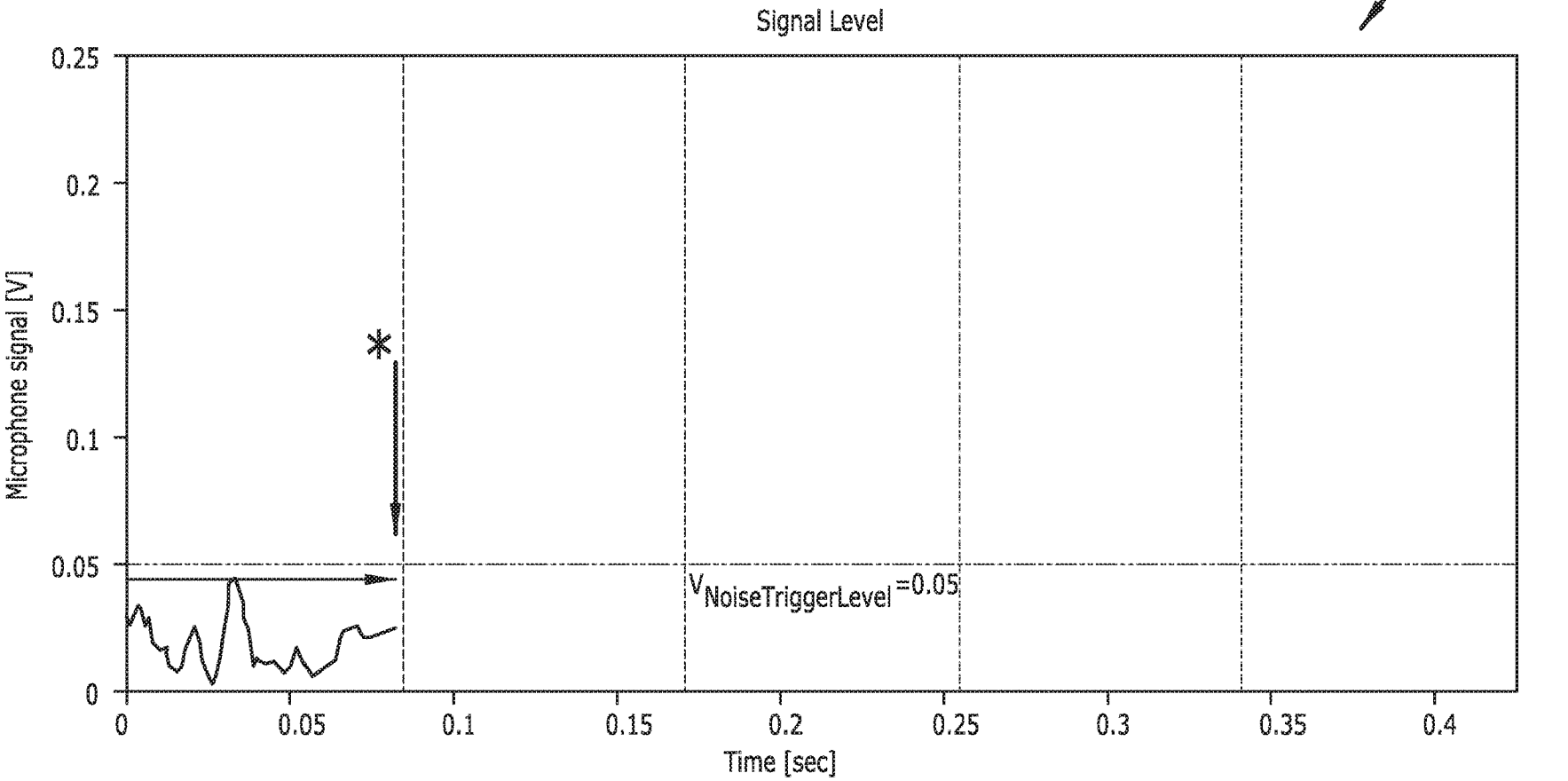
FIGS. 6A and 6B are graphs of signals received by an accessory in accordance with an embodiment of the presently disclosed technology.
Figure 6B:
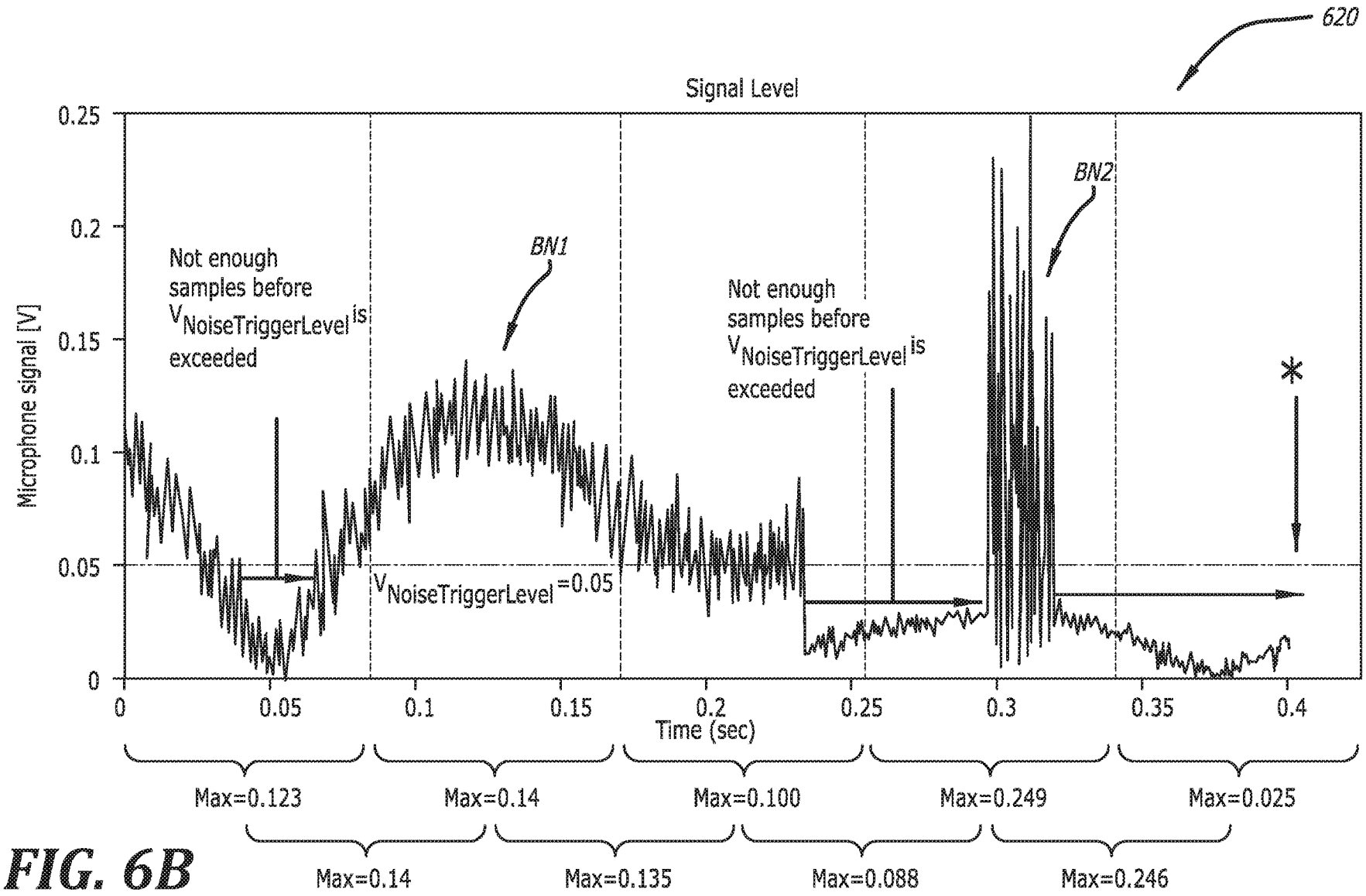

FIGS. 6A and 6B are graphs 610, 620 of signals received by an accessory in accordance with an embodiment of the presently disclosed technology. The horizontal axes in the graphs represent time in seconds, and the vertical axes represent microphone signal intensity in Volts. The microphone signal in the graph 610 was acquired under relatively quiet conditions, while the microphone signal in the graph 620 was acquired against a relatively high background acoustic noise. Some non-exclusive examples of the sources of background noise are fitter-patient conversation, air conditioning fans, printers, contact between the programming accessory and skin/hair in the ear canal, etc. In some embodiments of the inventive technology, when the acoustic bit is emitted the duration of the emission time is not fixed in advance. Instead, the speaker of the hearing instrument continuously emits a bit of information (i.e., acoustic signal at a given frequency) up to the time when the accessory completes acquisition of the bit, and requests the next bit. The accessory may determine that the microphone has properly acquired the bit if the acoustic signal at the microphone remains below a noise threshold for a duration of time (in the time or frequency domains). Stated differently, depending on the level of background noise, the accessory may dynamically adjust the duration of the bit acquisition. In other embodiments, the hearing instrument itself may use sampling from its own microphone to monitor SNR and to decide what is the duration of the current acoustic bit.

With the graphs in FIGS. 6A and 6B, the noise threshold is set at 0.05 V. For example, in the graph 610, the level of background noise is relatively low, never exceeding the noise threshold of 0.05 V. As a result, the acquisition of the bit is completed at about 0.08 seconds into the acquisition (marked by the asterisk sign), which, in this embodiment, corresponds to the minimum dwell time for the bit acquisition. Next, the accessory sends a request for the next bit to the hearing instruments or, if the last bit is received, the process ends.

In the graph 620, the level of background noise is relatively high. For example, the bursts of noise BN1 and BN2 do not allow the signal at the microphone to remain below the 0.05 V threshold for the required duration of dwell time (0.08 seconds) during the initial 0.32 seconds. The horizontal brackets below the time axis indicate the maximum value of the signal for the bracketed period of time. For example, the maximum value of the signal ranges from 0.088 V to 0.0249 for several time segments of 0.08 seconds (the minimum dwell time for the bit acquisition). Only at about 0.4 seconds into the signal acquisition, the signal remained below the 0.05 V threshold for the requisite duration of the dwell time of 0.08 seconds (marked by the asterisk sign), thus resulting in the acquisition of the bit.

The noise threshold of 0.05 V and the dwell time of 0.008 seconds are sample values in the illustrated embodiments. Other values may be used in different embodiments.

Figure 7:
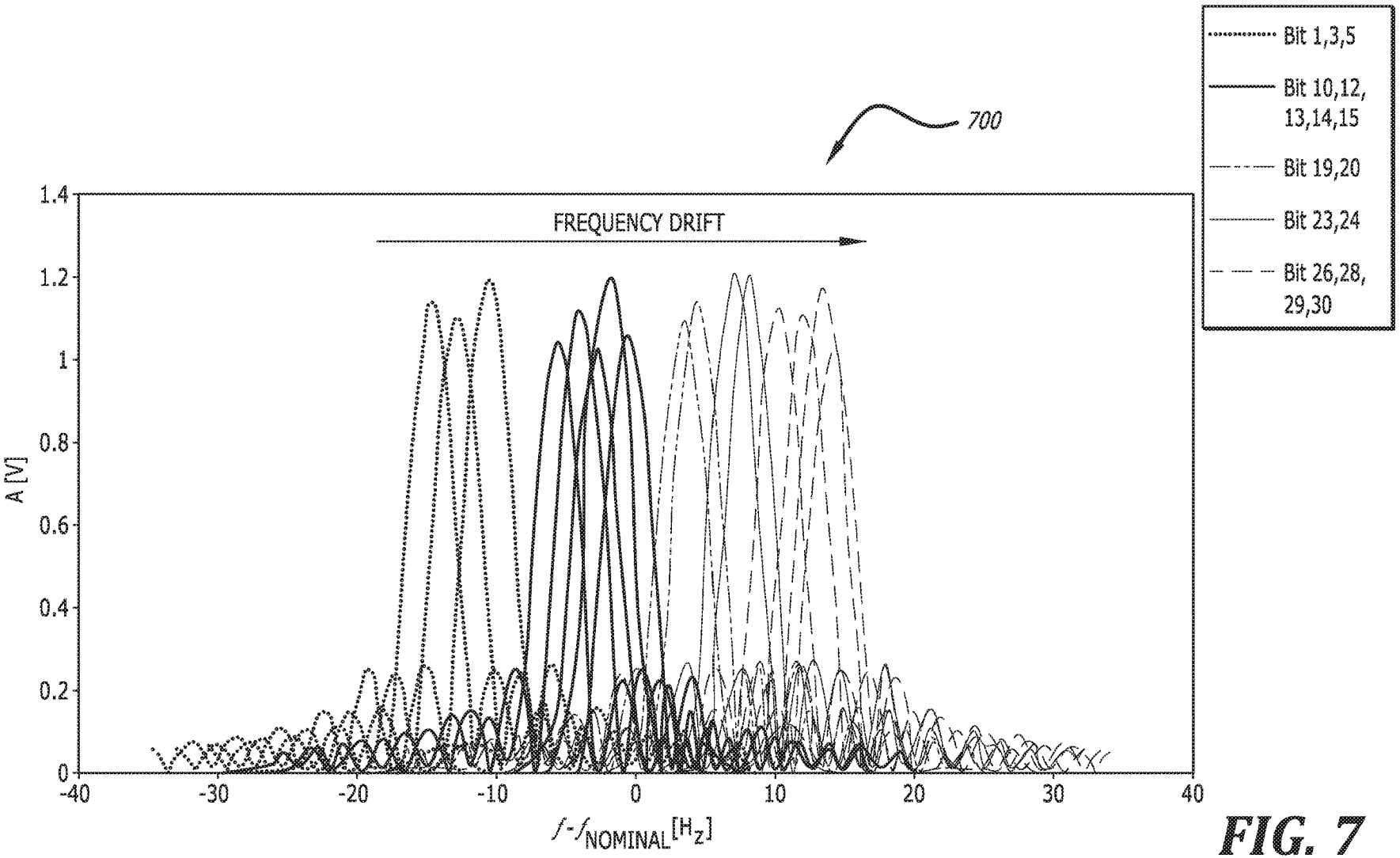
FIG. 7 is a spectral graph of signals received by an accessory in accordance with an embodiment of the presently disclosed technology.

FIG. 7 is a spectral graph 700 of signals received by an accessory in accordance with an embodiment of the presently disclosed technology. The horizontal axis shows a difference between the observed frequency and the expected nominal frequency of the acoustic signal ($f-f_{NOMINAL}$) in Hz. The vertical axis shows signal power. The sample bit sequence of the signal emitted by the speaker of the hearing instrument and acquired by the microphone of the accessory is: 101010000101111000110011010111. Bits "1" are shown in the graph (e.g., high frequency signal of the $1^{st}$ $3^{rd}$, $5^{th}$, $10^{th}$, $12^{th}$, $13^{th}$, $14^{th}$, $15^{th}$, $19^{th}$, $20^{th}$, 23th, $24^{th}$, $26^{th}$, $28^{th}$, $29^{th}$, and $30^{th}$ bit in the sample sequence). In general, similar graph can be made for the bits "0" in the above sequence of the bits.

In absence of the frequency drift, the illustrated bits in the graph 700 would cluster about the middle of the graph where $f-f_{NOMINAL}=0$. However, the internal clock of the hearing instrument may drift because of, for example, battery voltage droop, changes in the temperature, or other reasons. For the embodiment illustrated in graph 700, such frequency drift is about +/−18 Hz within the bit readout, but the drift may be different for other readouts or for different hearing instrument.

Figure 8A:
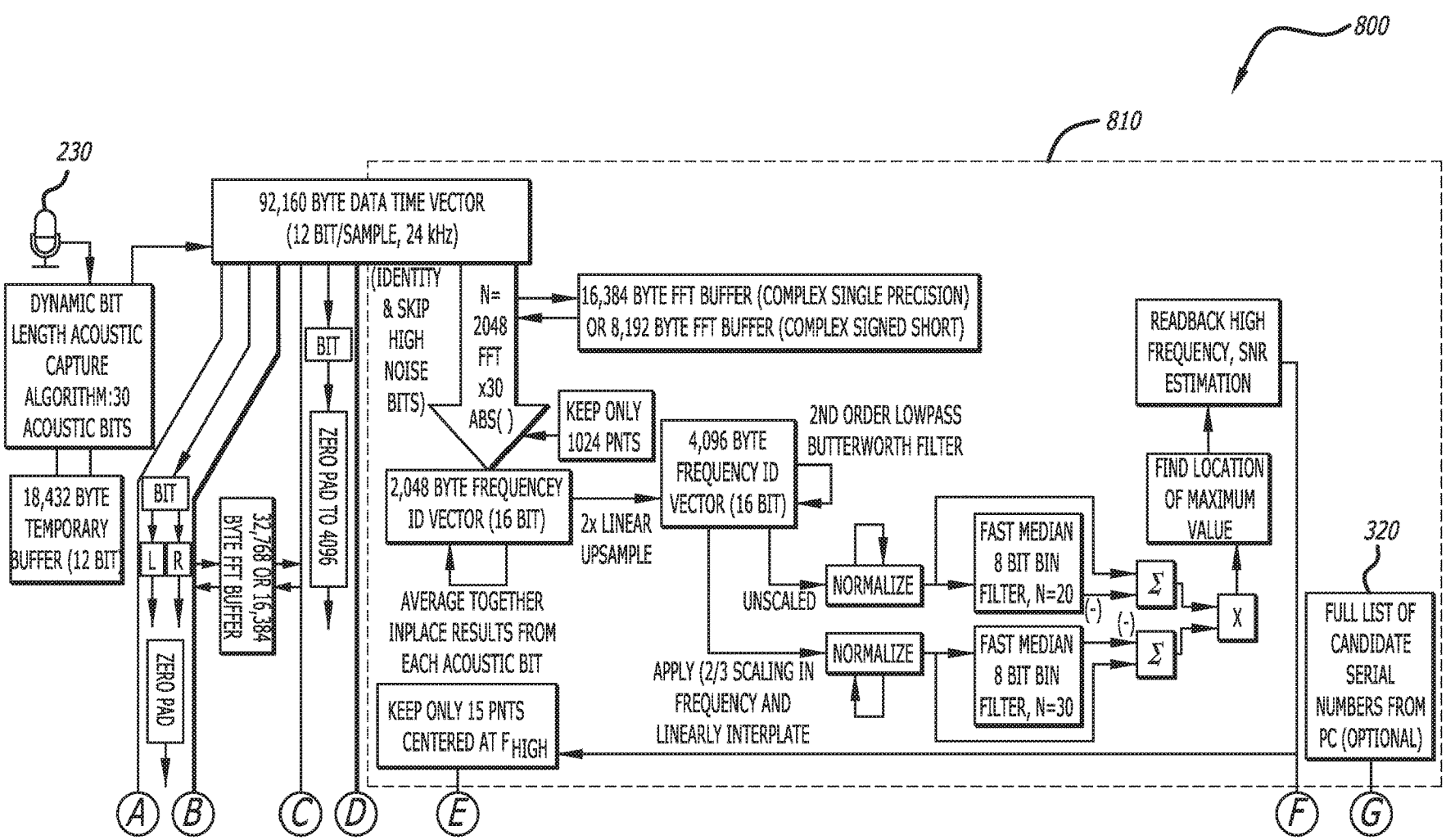
FIGS. 8A and B combine to form a block diagram of signal processing in accordance with an embodiment of the presently disclosed technology.
Figure 8B:
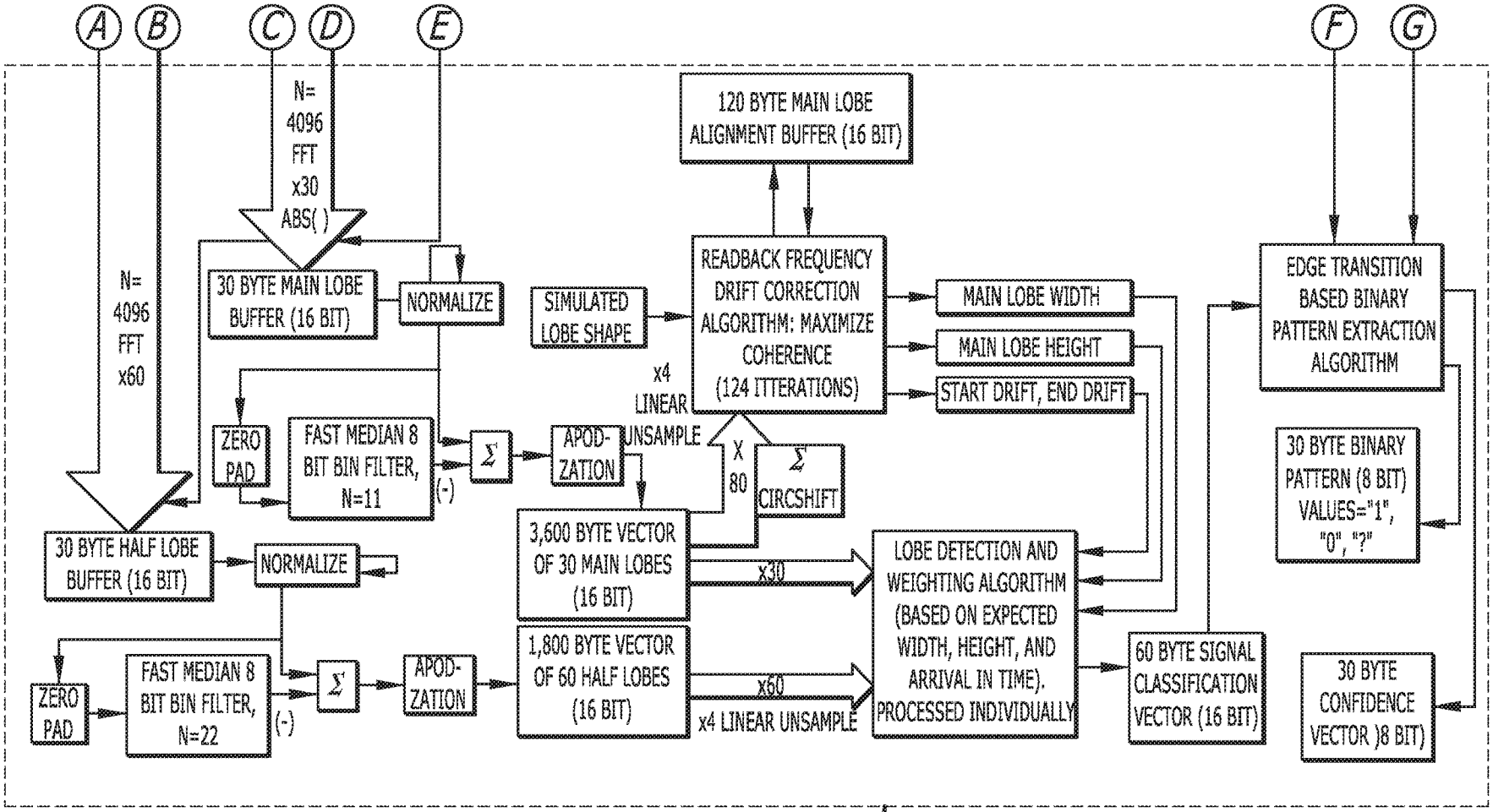

FIGS. 8A and 8B combine to form a block diagram 800 of signal processing in accordance with an embodiment of the presently disclosed technology. In some embodiments, the frequency drift, frequency harmonics, signal noise and/or other issues with the data can be addressed through signal processing of the data acquired by the microphone, and digitized by the A/D converter. For example, the microphone 230 may acquire a total of 92,160 bytes of data, each byte having 12 bits, at 24 kHz data acquisition rate. Other data acquisition/processing parameters are possible in different embodiments (e.g., different numbers of iterations, averages, different size of buffers, etc.). Furthermore, in some embodiments, the block diagram may include additional steps or may be practiced without all steps illustrated in the diagram. In some embodiments, the order of the steps listed may be changed.

In block 810, the acquired data are processed using, for example, Fast Fourier Transform (FFT) to identify the dominant frequencies in the spectrum. The ratios of frequencies and their harmonics (e.g., 2:1 or 2:3) may also be determined in block 810.

In block 820, the data may be zero-padded and processed to determine frequency drift. Based on determinations of dominant frequencies and frequency drift, bit patterns can be determined to reconstruct the sequence of bits 1 ($f_H$) and 0 ($E_L$) emitted by the speaker of the hearing instrument. This reconstruction of the sequence of bits may be based on expected width, height, and frequency drift of each lobe. As explained above, the emitted sequence of bits corresponds to one or more parameters of the hearing instrument (e.g., serial number of the hearing instrument, readings from onboard sensors, battery voltage, current settings of the settable switches, etc.).

The steps of the block diagram 800 are executed by the accessory 200. However, in different embodiments, the steps may be at least partially executed by the electronics and software of the hearing instruments, by an outside controller or computer, or by combinations of these systems.

Many embodiments of the technology described above may take the form of computer-executable or controller-executable instructions, including routines stored on non-transitory memory and executed by a programmable computer or controller. Those skilled in the relevant art will appreciate that the technology can be practiced on computer/controller systems other than those shown and described above. The technology can be embodied in a special-purpose computer, application specific integrated circuit (ASIC), controller or data processor that is specifically programmed, configured or constructed to perform one or more of the computer-executable instructions described above. In many embodiments, any logic or algorithm described herein can be implemented in software or hardware, or a combination of software and hardware.

From the foregoing, it will be appreciated that specific embodiments of the technology have been described herein for purposes of illustration, but that various modifications may be made without deviating from the disclosure. For example, the bit "1" may correspond to the low frequency, while the bit "0" corresponds to the high frequency of the acoustic signal emitted by the hearing aid. Moreover, while various advantages and features associated with certain embodiments have been described above in the context of those embodiments, other embodiments may also exhibit such advantages and/or features, and not all embodiments need necessarily exhibit such advantages and/or features to fall within the scope of the technology. Accordingly, the disclosure can encompass other embodiments not expressly shown or described herein.

We claim:

1. An accessory for communication with a hearing device, the accessory comprising:

an acoustic filter; and a microphone configured as an acoustic receiver (RX) for acoustic signals from a speaker of the hearing device via the acoustic filter, wherein the acoustic filter is configured to operate at at least one resonance frequency.

2. The accessory of claim 1, wherein the acoustic filter comprises a first acoustic channel having a first cross sectional area.

3. The accessory of claim 2, wherein the acoustic filter comprises a second acoustic channel having a second cross sectional area, wherein the second cross sectional area is smaller than the first cross sectional area, wherein the first acoustic channel and the second channel are connected, and wherein the microphone is placed at a longitudinal end of the second channel.

4. The accessory of claim 3, wherein the acoustic filter is a first acoustic filter, the accessory further comprising:

a second acoustic filter, comprising:

a third channel having a third diameter, and a fourth channel having a fourth diameter, wherein the third and fourth channels are connected, and wherein the fourth diameter is smaller than the third diameter; and a second microphone configured as an acoustic RX for acoustic signals from the speaker of the hearing device via the second acoustic filter.

5. The accessory of claim 3, wherein the first acoustic channel has a first length and the second acoustic channel has a second length, and wherein at least one of the first cross sectional area, the second cross sectional area, the first length and the second length are adjustable.

6. The accessory of claim 2, wherein the microphone is a first microphone configured at a longitudinal end of the first acoustic channel, wherein the acoustic filter comprises a second acoustic channel having a second cross sectional area, wherein the second cross sectional area is smaller than the first cross sectional area, and wherein the second microphone is placed at a longitudinal end of the second channel.

7. The accessory of claim 1, wherein the accessory is configured for acoustic and magnetic communication with the hearing device.

8. The accessory of claim 1, wherein the accessory is an element of a hearing system, the hearing system further comprising the hearing device.

9. The accessory of claim 1, wherein the microphone is a first microphone, the accessory further comprising a second microphone configured to detect a background noise.

10. The accessory of claim 1, wherein the first acoustic channel and the second acoustic channel are at least partially configured within an elongated protruding tip of the accessory.

11. The accessory of claim 1, further comprising:

an analog to digital converter (A/D) operatively coupled with the microphone; and a controller configured to process digital data obtained by the A/D.

12. The accessory of claim 1, wherein the hearing device is a completely in ear canal (CIC) hearing device.

13. A non-transitory computer-readable medium having computer-executable instructions stored thereon that, in response to execution by one or more processors of a computing device, cause the computing device to perform actions comprising:

sending a first accessory signal from an accessory to the hearing device;

in response to the first accessory signal, emitting a first acoustic signal by a speaker of the hearing device;

receiving the first acoustic signal by a microphone of the accessory; and in response to receiving the first acoustic signal, sending a second accessory signal to the hearing device to request a second acoustic signal.

14. The non-transitory computer-readable medium of claim 13, wherein the accessory comprises:

an acoustic filter, comprising:

a first acoustic channel having a first diameter; and a second acoustic channel having a second diameter, wherein the first channel and the second channel are connected, wherein the second diameter is smaller than the first diameter, and wherein the microphone is placed at a longitudinal end of the second channel, wherein the microphone is acoustically connected with the speaker of the hearing device via the acoustic filter.

* * * * *